US005643708A

United States Patent [19]

Lin

[11] Patent Number: 5,643,708

[45] Date of Patent: Jul. 1, 1997

[54] TONER AND DEVELOPER COMPOSITIONS

[75] Inventor: Pinyen Lin, Rochester, N.Y.

[73] Assignee: Xerox Corporation, Stamford, Conn.

[21] Appl. No.: 573,976

[22] Filed: Dec. 18, 1995

[51] Int. Cl.[6] ..... G03G 9/087

[52] U.S. Cl. ..... 430/137

[58] Field of Search ..... 430/109, 110, 430/137

[56] References Cited

U.S. PATENT DOCUMENTS

| | | | |
|---|---|---|---|
| 4,338,390 | 7/1982 | Lu | 430/106 |
| 4,394,430 | 7/1983 | Jadwin et al. | 430/110 |
| 5,004,666 | 4/1991 | Tomono et al. | 430/110 |
| 5,023,158 | 6/1991 | Tomono et al. | 430/99 |
| 5,066,558 | 11/1991 | Hikake et al. | 430/109 |
| 5,102,763 | 4/1992 | Winnik et al. | 430/109 |

*Primary Examiner*—John Goodrow
*Attorney, Agent, or Firm*—E. O. Palazzo

[57] ABSTRACT

A process for the preparation of toner compositions which comprises the mixing of a wax and silica particles, and thereafter adding the mixture to a mixture of toner resin, and pigment.

20 Claims, No Drawings

TONER AND DEVELOPER COMPOSITIONS

BACKGROUND OF THE INVENTION

The invention is generally directed to toner and developer compositions, and more specifically, the present invention is directed to processes for the preparation of toners with improved wax dispersion and wherein in embodiments the use of compatibilizers can be avoided. In embodiments the process of the present invention is directed to the preparation of a master batch of wax and flow aid additives, such as silica particles, by the premixing of the wax and silica, and thereafter adding the resulting mixture to resin particles and pigment to enable the generation of a toner with improved wax dispersion. Also, in embodiments the toner prepared in accordance with the present invention contains, for example, less than 10 percent (by number) articles smaller than 4 microns in volume average diameter, and less toner fines after classification; thus, for example, fewer classifications are needed to obtain the desired fines content. Less toner fines results in less toner impaction onto the carriers in the developer housing, improved toner powder flow, and lower amounts of toner surface additives are needed. Improved wax dispersion obtained with the processes of the present invention was illustrated by TEM micrographs. Also, the toners of the present invention possess excellent classification efficiencies, high hot offset temperatures of, for example, between 400° F. and 500° F., superior melt (MFT) fusing temperatures between 200° F. and 310° F., and broad fusing latitudes of 90° F. to 250° F. Moreover, in embodiments of the present invention there are enabled toners with rapid admix of less than about 15 seconds, extended developer life, stable electrical properties, high image print quality with substantially no background deposits, and compatibility with fuser rolls including VITON® fuser rolls. The aforementioned toner compositions contain pigment particles comprised of, for example, carbon black, magnetites, or mixtures thereof, cyan, magenta, yellow, blue, green, red, or brown components, or mixtures thereof thereby providing for the development and generation of black and/or colored images. The toner and developer compositions of the present invention can be selected for electrophotographic, especially xerographic imaging and printing processes, including color processes.

Toners with waxes, such as low molecular weight waxes, are known as illustrated herein. Problems encountered with waxy toners are as illustrated herein and include the poor wax dispersion of the wax in the toner. Poor wax dispersion enables the wax to escape from the toner and thereby adversely effect the toner characteristics, and deposit on copying and printing machine parts. Loose wax particles are likely to be taken out by toner classification, which provides lower wax content in the final toner products and causes problems in toner fines recycling. Poor wax dispersion also provides poor toner powder flow, and the need for higher amount contents of surface additives, which can cause problems in toner RH sensitivity. Poor toner powder flow leads to lower efficiency in the toner classification processes and more time is needed to remove the toner fines. These and other problems are avoided, or minimized with the processes of the present invention.

Toners with low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., and similar materials, are known. The commercially available polyethylenes selected have a molecular weight of from about 1,000 to about 1,500, while the commercially available polypropylenes are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The aforementioned toners are usually prepared by simply adding the wax to the components contained in the toner, followed by mixing with heat, jetting, and classification. The wax in these toners escapes and causes the problems mentioned herein. Moreover, toners with surface additives of silica, such as fumed silicas, are known.

Further, developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 4,394,430, and 4,560,635 which illustrates a toner with a distearyl dimethyl ammonium methyl sulfate charge additive, These and other known charge additives can be selected for the toners and processes of the present invention.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271, the disclosure of which is totally incorporated herein by reference, a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

SUMMARY OF THE INVENTION

It is an object of the present invention to provide toner and developer compositions with many of the advantages illustrated herein.

In another object of the present invention there are provided processes for the preparation of toner compositions with excellent wax dispersions, and wherein the escape of wax from the toner is avoided, or minimized.

In another object of the present invention there are provided processes for the preparation of mixtures of silica particles and wax, and which mixture can be selected for the preparation of toners and developers, and wherein offsetting of the toners to fuser rolls is minimized enabling developed electrostatic images with excellent resolution and substantially no background deposits.

In yet a further object of the present invention there are provided humidity insensitive, from about, for example, 20 to 80 percent relative humidity at temperatures of from 60° to 80° F. as determined in a relative humidity testing chamber, toner compositions with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Further, in another object of the present invention there are provided toners with improved wax dispersions with excellent powder flow, as compared, for example, to many prior art toners wherein a high, 15 percent to 50 percent by number, fines content is present, and which high fines content is reduced to 0 percent to 10 percent after classification with the invention processes.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles, dispersed wax, and optional charge enhancing additives. More specifically, the present invention in embodiments is directed to processes for the preparation of toner compositions comprised of resin, pigment, or dye, and a wax dispersion, or a wax dispersion comprised of a flow aid additive, like fumed silicas, such as AEROSILS® available from DeGussa Chemicals, and a wax. In embodiments, the process of the present invention comprises the mixing, or extruding of the wax with a silica, such as the AEROSILS®, and more specifically, silica TS530 powder. Thereafter, the aforementioned wax mixture is selected for the preparation of toner compositions.

The process of the present invention comprises the following steps in specific embodiments thereof: TS530, a fumed silica, in an amount of 10 percent to 20 percent by weight was extruded with polypropylene 660P wax available from Sanyo Chemicals. The temperature range of the extruder can be from about 80° C. to 160° C., or 20° C. above the melting point of the wax. The mixing temperature was preferably from about 100° to about 130° C. The residence time of extrusion is from 15 seconds to 4 minutes.

The resulting wax/silica mixture was then extruded with a thermoplastic toner resin, especially the extruded polyester of U.S. Pat. No. 5,376,494, the disclosure of which is totally incorporated herein by reference. A thin slice of toner samples was examined under optical microscope to determine the wax dispersion. A photograph of a toner sample slice image is taken and the wax dispersion can be compared visually. Table 1 that follows provides data for the toner compositions with resin, pigment, wax/silica mixture prepared as above. The classification data in Table 1 indicates that all toners (with 10 percent or 20 percent TS530 in the wax) have less than 10 percent fines by number with double passes. Typical fines contents of a toner are about 16 to 20 percent by number with double passes and 8 to 11 percent by number with triple passes under the same classification conditions. Toner with 20 percent TS530 in the wax had similar fines content as the toner with 10 percent TS530 in wax. Toner #2 (without the compatibilizer AX8840) showed less fines than Toner #1 (with AX8840).

TABLE 1

TONERS CONTAINING MODIFIED WAX

| ID | Composition | No. of Times Through Classification | Fines (μm %) | MFT (°C.) | HOT (°C.) |
|---|---|---|---|---|---|
| #1 | 86% Polyester, 5% REGAL 330, 4% 660P, 1% TS530, 4% AX8840 | 1 | 24.09 | | |
| | 86% Polyester, 5% REGAL 330, 4% 660P, 1% TS530, 4% AX8840 | 2 | 9.70 | | |
| | 86% Polyester 5% REGAL 330, 4% 660P, 1% TS530, 4% AX8840 | 3 | 4.75 | 135 | 62 |
| #2 | 91% Polyester, 5% REGAL 330, 4% 660P, 1% TS530 | 1 | 21.59 | | |
| | 91% Polyester, 5% REGAL 330, 4% 660P, 1% TS530 | 2 | 6.13 | | |
| | 91% Polyester, 5% REGAL 330, 4% 660P, 1% TS530 | 3 | 2.66 | 139 | >58 |
| #3 | 87% Polyester, 5% REGAL 330, 3.6% 660P, 0.4% TS530, 4% AX8840 | 3 | 3.87 | 139 | >55 |
| #4 | 91% Polyester, 5% REGAL 330, 3.6% 660P, 0.4% TS530 | 1 | 22.84 | | |
| | 91% Polyester, 5% REGAL 330, 3.6% 660P, 0.4% TS530 | 2 | 8.51 | | |
| | 91% Polyester, 5% REGAL 330, 3.6% 660P, 0.4% TS530 | 3 | 2.22 | 140 | >63 |

The fusing results in Table 1 show that all toners (10 percent and 20 percent TS530 in wax) provided excellent MFT and high HOT. Toner with 20 percent TS530 in wax had similar fusing results as the toner with 10 percent TS530 in wax.

In another embodiment of the present invention there are provided subsequent to known micronization and classification toner particles with an average diameter of from about 10 to about 20 microns comprised of resin particles, pigment particles, and wax mixture.

The toner compositions of the present invention can be prepared by a number of known methods such as admixing and heating resin particles such as styrene butadiene copolymers, pigment particles such as magnetite, carbon black, or mixtures thereof, the mixture of wax and silica, and preferably from about 0.5 percent to about 5 percent of charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing the minimal fines, if any that are present, that is toner particles less than about 4 microns volume median diameter.

Illustrative examples of suitable toner resins selected for the toner and developer compositions of the present invention include polyamides, polyolefins, styrene acrylates, styrene methacrylates, styrene butadienes, crosslinked styrene polymers, polyesters, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof, and the like; and styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 6,000, such as polyethylene, polypropylene, and paraffin waxes, can be included in, or on the toner compositions as fuser roll release agents.

The preferred toner resins are the extruded polyesters as illustrated in U.S. Pat. No. 5,376,494, the disclosure of which is totally incorporated herein by reference.

The resin particles are present in a sufficient, but effective amount, for example from about 70 to about 90 weight percent. Thus, in embodiments when 4 percent of the wax is present, 0.4 to 1.0 weight percent of silica, and 0.1 percent by weight of a charge enhancing additive is present, 8 percent by weight of pigment or colorant, such as carbon black, is contained therein, about 94 percent by weight of resin is selected.

Numerous well known suitable pigments or dyes can be selected as the colorant for the toner particles including, for example, carbon black, nigrosine dye, aniline blue, magnetite, or mixtures thereof. The pigment, which is preferably REGAL 330® carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetite thereby enabling single component toners in some instances, which magnetites contain a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Examples of low molecular weight waxes include polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected are believed to possess a weight average molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles and carrier particles, and as toner pigments or colorants red, blue, green, brown, magenta, cyan and/or yellow particles, as well as mixtures thereof. Illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. No. 4,937,166, and U.S. Pat. No. 4,935,326, the disclosures of which are totally incorporated herein by reference, including for example KYNAR® and polymethyl methacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably about 75 to about 95 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 100 parts to about 200 parts by weight of carrier are selected.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 2 femtocoulombs per micron in embodiments thereof as determined by the known charge spectograph. Admix time for the toners of the present invention are preferably from about 5 seconds to 1 minute, and more specifically, from about 5 to about 15 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Embodiments of the present invention include a process for the preparation of toner compositions which comprises the mixing of a wax and silica particles, and thereafter, adding the mixture to a mixture of toner resin, and pigment; a process for the preparation of toner compositions which comprises the mixing of a wax and colloidal silica particles, and subsequently adding the formed mixture to thermoplastic resin, and pigment; a toner process wherein the amount of wax selected is from about 60 to about 99 weight percent; the amount of silica selected is from about 1 to about40 weight percent, wherein the amount of wax selected is from about 1 to about 20 weight percent, and the amount of silica selected is from about 0.1 to about 3 weight percent; wherein the mixing is for a period of from about 15 seconds to about 12 minutes; wherein the mixing is accomplished with heating at a temperature of about 30° C. below the melting point of the wax to a temperature of about 50° C. above the melting point of the wax; wherein the mixture of wax and silica is selected in an amount of from about 2 to about 30 weight percent; wherein the weight average molecular weight of the wax is from about 1,000 to about 20,000; wherein there is added to the toner a charge additive in an amount of from about 0.05 to about 5 weight percent; a method of imaging which comprises formulating an electrostatic latent image on a photoreceptor, affecting development thereof with the toner composition obtained by the invention process, and thereafter, transferring the developed image to a suitable substrate; and a process for improving wax dispersion in a toner which comprises initially mixing wax and fumed colloidal silica particles, followed by contacting said formed mixture with toner resin, and toner pigment.

The following Examples are being supplied to further define various species of the present invention, it being noted that these Examples are intended to illustrate and not limit the scope of the present invention. Parts and percentages are by weight unless otherwise indicated.

EXAMPLE I

TS530, a hydrophobic treated fumed silica obtained from Cabot Corporation, (4 lbs.) was blended with VISCOL 660P™ polypropylene wax obtained from Sanyo Kasei K. K. (36 lb). The resulting blend was then fed into a Werner & Pfleiderer twin screw extruder at 20 pounds per hour using a loss-in-weight feeder. The mixing was accomplished in an extruder using the following process conditions: barrel temperature profile of 100/110/120/125/130, die head temperature of 115° C., screw speed of 100 revolutions per minutes and average residence time of about three minutes. The extrudate melt, upon exiting from the strand die, was cooled in a water bath and pelletized.

Thereafter, a toner was prepared using a Werner & Pfleiderer twin screw extruder. The composition of the toner was 4 percent of the above prepared 660P/TS530 extrudate, 5 percent of REGAL 330®, and 91 percent of a crosslinked polyester resin, reference U.S. Pat. No. 5,376,494, the disclosure of which is totally incorporated herein by reference; and more specifically, a bisphenol A based polyester with a 30 percent gel content, the same polyester as selected in the Table 1 data.

There was thus prepared in an extrusion device, available as ZSK40 from Werner Pfleiderer, a toner composition by adding thereto 91 percent by weight of crosslinked bisphenol A type polyester with a gel content of about 30 percent toluene insoluble, reference U.S. Pat. No. 5,352,556, the disclosure of which is totally incorporated herein by reference; 5 percent by weight of REGAL 330® carbon black; and 4 percent by weight of 660P/TS530 extrudate from above. The toner product, which was extruded at a rate of 200 pounds per hour, reached a melting temperature of 149° C. The strands of melt mixed product exiting from the extruder were cooled by immersing them in a water bath maintained at room temperature, about 25° C. Subsequent to air drying, the resulting toner was subjected to grinding in an Alpine Fluid Bed Jet Model 200 AFG, available from Hosokawa Micron International, enabling particles with a volume median diameter of from 8 to 12 microns as measured by a Coulter Counter. Thereafter, the aforementioned toner particles were classified 1 to 3 times in a Donaldson Model B classifier for the purpose of removing fine particles, that is those toner particles with a volume median diameter of less than 4 microns. The fines content of the toner after each classification was also measured by a Coulter Counter. Subsequently, the above formulated toner, 4 parts by weight, was mixed with 96 parts by weight of a carrier containing a 130 μm steel core coated with 0.05 percent by weight of polyvinylidene fluoride (KYNAR®) coating. This developer was then placed in a high speed electrostatic imaging machine available from Xerox Corporation as the 1090™. The Hot Offset Temperature was evaluated as the temperature that the toner image starts to offset onto the fuser roll, see Table 2 that follows. The advantages of higher HOT, lower MFT and lower fines percent under the same classification conditions resulted.

TABLE 2

| Composition | No. of Times Through Classification | Fines (Num. %) | MFT (°C.) | HOT (°C.) |
|---|---|---|---|---|
| 86% Polyester, 5% REGAL 330, 4% 660P, 1% TS530, 4% AX8840 | 1 | 24.09 | | |
| 86% Polyester, 5% REGAL 330, 4% 660P, 1% TS530, 4% AX8840 | 2 | 9.70 | | |
| 86% Polyester, 5% REGAL 330, 4% 660P, 1% TS530, 4% AX8840 | 3 | 4.75 | 135 | 62 |
| 91% Polyester, 5% REGAL 330, 4% 660P, 1% TS530 | 1 | 21.59 | | |
| 91% Polyester, 5% REGAL 330, 4% 660P, 1% TS530 | 2 | 6.13 | | |
| 91% Polyester, 5% REGAL 330, 4% 660P, 1% TS530 | 3 | 2.66 | 139 | >58 |
| 87% Polyester, 5% REGAL 330, 3.6% 660P, 0.4% TS530, 4% AX8840 | 3 | 3.87 | 139 | >55 |
| 91% polyester, 5% REGAL 330, 3.6% 660P, 0.4% TS530 | 1 | 22.84 | | |
| 91% polyester, 5% REGAL 330, 3.6% 660P, 0.4% TS530 | 2 | 8.51 | | |
| 91% polyester, 5% REGAL 330, 3.6% 660P, 0.4% TS530 | 3 | 2.22 | 140 | >63 |
| 91% Polyester, 5% REGAL 330, 4% 660P | 3 | 8–11 | 157 | >46 |
| 87% Polyester, 5% REGAL 330, 4% 660P, 4% AX8840 | 3 | 8–11 | 154 | 55 |

EXAMPLE II

The toner composition of Example I (4 percent of 660P/TS530 extrudate from Example I, 5 percent of REGAL 330®, 4 percent of ethylene copolymer compatibilizer, AX8840 obtained from Elf Atochem North America, Inc., and 87 percent of crosslinked bisphenol A type polyester resin with about 30 percent of toluene insoluble) was prepared. The toner preparation and fusing evaluation procedures were the same as Example I.

EXAMPLE III

TS530 (8 lb.) was blended with 660P wax (32 lb.). The resulting blend was then fed into a Werner & Pfleiderer twin screw extruder at 20 pounds per hour using a loss-in-weight feeder. The mixing was carried out in the extruder using the following process conditions: barrel temperature profile of 100/110/120/125/130, die head temperature of 115° C., screw speed of 100 revolutions per minute, and average residence time of about three minutes. The extrudate melt, upon exiting from the strand die, was cooled in a water bath and pelletized.

Thereafter, a toner was prepared using a Werner & Pfleiderer twin screw extruder. The composition of the toner was 5 percent of 660P/TS530 extrudate, 5 percent of REGAL 330®, and 90 percent of crosslinked polyester resin.

EXAMPLE IV

The composition of the toner of this Example was 5 percent of 660P/TS530 extrudate from Example III, 5 percent of REGAL 330®, 4 percent of ethylene copolymer AX8840 from Elf Atochem North America, Inc., and 86 percent of crosslinked bisphenol A type polyester resin with about 30 percent of toluene insoluble. The toner preparation and fusing evaluation procedures are the same as those of Example I.

EXAMPLE V

Toner was prepared using a Werner & Pfleiderer twin screw extruder by repeating the process of Example I. The composition of the toner was 4 percent of 660P, 5 percent of REGAL 330®, and 91 percent of crosslinked bisphenol A type polyester resin with about 30 percent of toluene insoluble.

There was thus prepared in an extrusion device, available as ZSK40 from Werner Pfleiderer, a toner composition by adding thereto 91 percent by weight of crosslinked bisphenol A type polyester with about 30 percent of toluene insoluble, reference U.S. Pat. No. 5,352,556, the disclosure of which is totally incorporated herein by reference; 5 percent by weight of REGAL 330® carbon black; 1 weight percent of TS530; and 4 percent by weight of 660P wax. The toner product, which was extruded at a rate of 200 pounds per hour, reached a melting temperature of 149° C. The strands of melt mixed product exiting from the extruder were cooled by immersing them in a water bath maintained at room temperature, about 25° C. Subsequent to air drying, the resulting toner was subjected to grinding in an Alpine Fluid Bed Jet Model 200 AFG, available from Hosokawa Micron International, enabling particles with a volume median diameter of from 8 to 12 microns as measured by a Coulter Counter. Thereafter, the aforementioned toner particles were classified 3 times in a Donaldson Model B classifier for the purpose of removing fine particles, that is those with a volume median diameter of less than 4 microns. The fines content of the toner after each classification was also measured by a Coulter Counter.

Subsequently, the above formulated toner, 4 parts by weight, was mixed with 96 parts by weight of a carrier containing a 130 μm steel core coated with 0.05 percent by weight of polyvinyl fluoride. This developer was then placed in a high speed electrostatic imaging machine available from Xerox Corporation as the 1090™. The Hot Offset Temperature was evaluated as the temperature that the toner image starts to offset onto the fuser roll.

EXAMPLE VI

Toner was prepared using a Werner & Pfleiderer twin screw extruder. The composition of the toner was 4 percent of 660P, 5 percent of REGAL 330®, 4 percent of ethylene copolymer (AX8840), and 87 percent of crosslinked bisphenol A type polyester resin with about 30 percent of toluene insoluble. The toner preparation and fusing evaluation procedures were the same as those of Example V.

Other toner and developer compositions were prepared by repeating the above processes, and substantially similar results were obtained.

Other modifications of the present invention may occur to those skilled in the art subsequent to a review of the present application, and these modifications, including equivalents thereof, are intended to be included within the scope of the present invention.

What is claimed is:

1. A process for the preparation of toner compositions consisting of the mixing or predispersion of a wax and colloidal silica particles, and subsequently adding the formed predispersion to thermoplastic resin and pigment, and whereby said wax is retained in said toner.

2. A process for the preparation of toner compositions which comprises the mixing or predispersion of a wax and colloidal silica particles, and subsequently adding the formed predispersion to thermoplastic resin and pigment, and whereby said wax is retained in said toner.

3. A process in accordance with claim 2 wherein the amount of wax selected is from about 60 to about 99 weight percent.

4. A process in accordance with claim 2 wherein the amount of silica selected is from about 1 to about 40 weight percent.

5. A process in accordance with claim 2 wherein the amount of wax selected is from about 1 to about 20 weight percent, and the amount of silica selected is from about 0.1 to about 3 weight percent.

6. A process in accordance with claim 2 wherein the mixing is for a period of from about 15 seconds to about 12 minutes.

7. A process in accordance with claim 2 wherein the mixing is accomplished with heating at a temperature of about 30° C. below the melting point of the wax to a temperature of about 50° C. above the melting point of the wax.

8. A process in accordance with claim 2 wherein the mixture of wax and silica is selected in an amount of from about to about 2 to about 30 weight percent.

9. A process in accordance with claim 2 wherein the weight average molecular weight of the wax is from about 1,000 to about 20,000.

10. A process in accordance with claim 2 wherein the weight average molecular weight of the wax is from about 5,000 to about 10,000.

11. process in accordance with claim 9 wherein the wax is polypropylene, or polyethylene.

12. A process in accordance with claim 2 wherein there is added a charge additive in an amount of from about 0.05 to about 5 weight percent.

13. A process in accordance with claim 2 wherein the resin is comprised of styrene polymers, polyesters, or mixtures thereof.

14. A process in accordance with claim 2 wherein the resin is comprised of styrene acrylates, styrene methacrylates, or styrene butadienes.

15. A process in accordance with claim 2 wherein the resin is comprised of an extruded polyester.

16. A process in accordance with claim 2 wherein there is added to the formed toner as external additives metal salts of a fatty acid, colloidal silicas, or mixtures thereof.

17. A process in accordance with claim 2 wherein the pigment is selected from the group consisting of carbon black, magnetites, cyan, magenta, yellow, red, blue, green, brown, and mixtures thereof.

18. A method of imaging which comprises formulating an electrostatic latent image on a photoreceptor, affecting development thereof with the toner composition obtained by the process of claim 2, and thereafter transferring the developed image to a suitable substrate.

19. A process for improving wax dispersion in a toner which comprises initially mixing wax and fumed colloidal silica particles, followed by contacting said formed mixture with toner resin, wax compatibilizer, and toner pigment.

20. A process in accordance with claim 2 wherein the mixture of thermoplastic resin and pigment is added to the predispersion mixture of wax and colloidal silica particles.

* * * * *